US009868053B1

(12) United States Patent
Tseng

(10) Patent No.: US 9,868,053 B1
(45) Date of Patent: Jan. 16, 2018

(54) PUSH DEVICE FOR MAHJONG TILES

(71) Applicant: Tzu-Hsiang Tseng, Taichung (TW)

(72) Inventor: Tzu-Hsiang Tseng, Taichung (TW)

( * ) Notice: Subject to any disclaimer, the term of this patent is extended or adjusted under 35 U.S.C. 154(b) by 0 days.

(21) Appl. No.: 15/253,874

(22) Filed: Sep. 1, 2016

(51) Int. Cl.
*A63F 9/00* (2006.01)
*A63F 11/00* (2006.01)
*A63F 9/20* (2006.01)

(52) U.S. Cl.
CPC ..... *A63F 11/0002* (2013.01); *A63F 9/20* (2013.01); *A63F 11/0025* (2013.01); *A63F 2009/205* (2013.01)

(58) Field of Classification Search
CPC ... A63F 9/20; A63F 11/0025; A63F 2009/205
USPC ..... 273/148 R; 463/16
See application file for complete search history.

(56) References Cited

U.S. PATENT DOCUMENTS 6,019,368 A * 2/2000 Sines ..... A63F 1/12 273/149 R
7,753,768 B2 * 7/2010 Hsu ..... A63F 9/20 273/293
8,892,244 B1 * 11/2014 Taylor ..... B25J 9/1687 156/64
2009/0275373 A1 * 11/2009 Hsu ..... A63F 9/20 463/11
2010/0175943 A1 * 7/2010 Bergmann ..... H02K 41/025 180/168
2012/0326388 A1 * 12/2012 Wang ..... A63F 9/20 273/148 R
2013/0001875 A1 * 1/2013 Wang ..... A63F 9/20 273/237

* cited by examiner

*Primary Examiner* — Vishu Mendiratta
(74) *Attorney, Agent, or Firm* — Raymond Y. Chan; David and Raymond Patent Firm

(57) ABSTRACT

A push device for mahjong tiles includes an input platform, a lift mechanism, a changeover platform, and a push mechanism. The lift mechanism includes a lift platform composed of an upper platform and a lower platform. The changeover platform is disposed at one side of the lift platform. The push mechanism includes a U-shaped push frame movable between the input platform, the lift platform, and the changeover platform. Thereby, the U-shaped push frame pushes the mahjong tiles from the input platform to the lower platform. When the mahjong tiles on the lower platform reaches a predetermined amount, the U-shaped push frame pushes the mahjong tiles to the changeover platform. The lift platform descends and the U-shaped push frame pushes the mahjong tiles from the changeover platform to the upper platform. The lift platform ascends again and the input platform inputs the mahjong tiles for the next game.

3 Claims, 9 Drawing Sheets

PUSH DEVICE FOR MAHJONG TILES

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a push device for mahjong tiles, and more particularly to a device able to arrange one set of mahjong tiles for playing a game and another set of mahjong tiles ready for the next game.

Description of Related Arts

Mahjong is a puzzle entertainment for all ages, which contains various changes. It is well known that Mahjong is one of the quintessence of Chinese culture. With the developments of technology and network, there are different mahjong games. During a variety of mahjong games, it is necessary to shuffle tiles, stack tiles, and deal tiles. In order to increase the fairness of the mahjong game and to prevent fraud, the players should reduce the chance of touching tiles. Therefore, a mahjong table able to shuffle, stack and retrieve tiles automatically is developed on the market. But, this mahjong table is only suitable to play a traditional mahjong game for four players to sit around the table. If the players want to play different mahjong games, it is necessary to arrange the mahjong tiles in good order for the sucker of the robotic arm to draw the tiles during the game. There is no auxiliary product able to automatically arrange the mahjong tiles in good order. It is necessary to automatically arrange the mahjong tiles in good order and to reduce the chance of touching the mahjong tiles so as to increase the fairness of the game and to prepare another set of mahjong tiles ready for the next game. Accordingly, the inventor of the present invention has devoted himself based on his many years of practical experiences to solve this problem.

SUMMARY OF THE PRESENT INVENTION

The primary object of the present invention is to solve the foregoing problems and to provide a push device for mahjong tiles includes an input platform, a lift mechanism, a changeover platform, and a push mechanism. The lift mechanism includes a lift platform composed of an upper platform for drawing the tiles during the game and a lower platform for collecting the tiles inputted externally. A U-shaped push frame pushes the mahjong tiles row by row to be collected together for playing a game. The U-shaped push frame displaces horizontally to push the remaining mahjong tiles on the upper platform to be retrieved. The lift platform ascends again and the U-shaped push frame pushes the mahjong tiles to the upper platform for the next game. The operation can be repeatedly to provide an automation function and reduce human intervention and decrease the waiting time for playing games.

DETAILED DESCRIPTION OF THE PREFERRED EMBODIMENT

Figure 1:
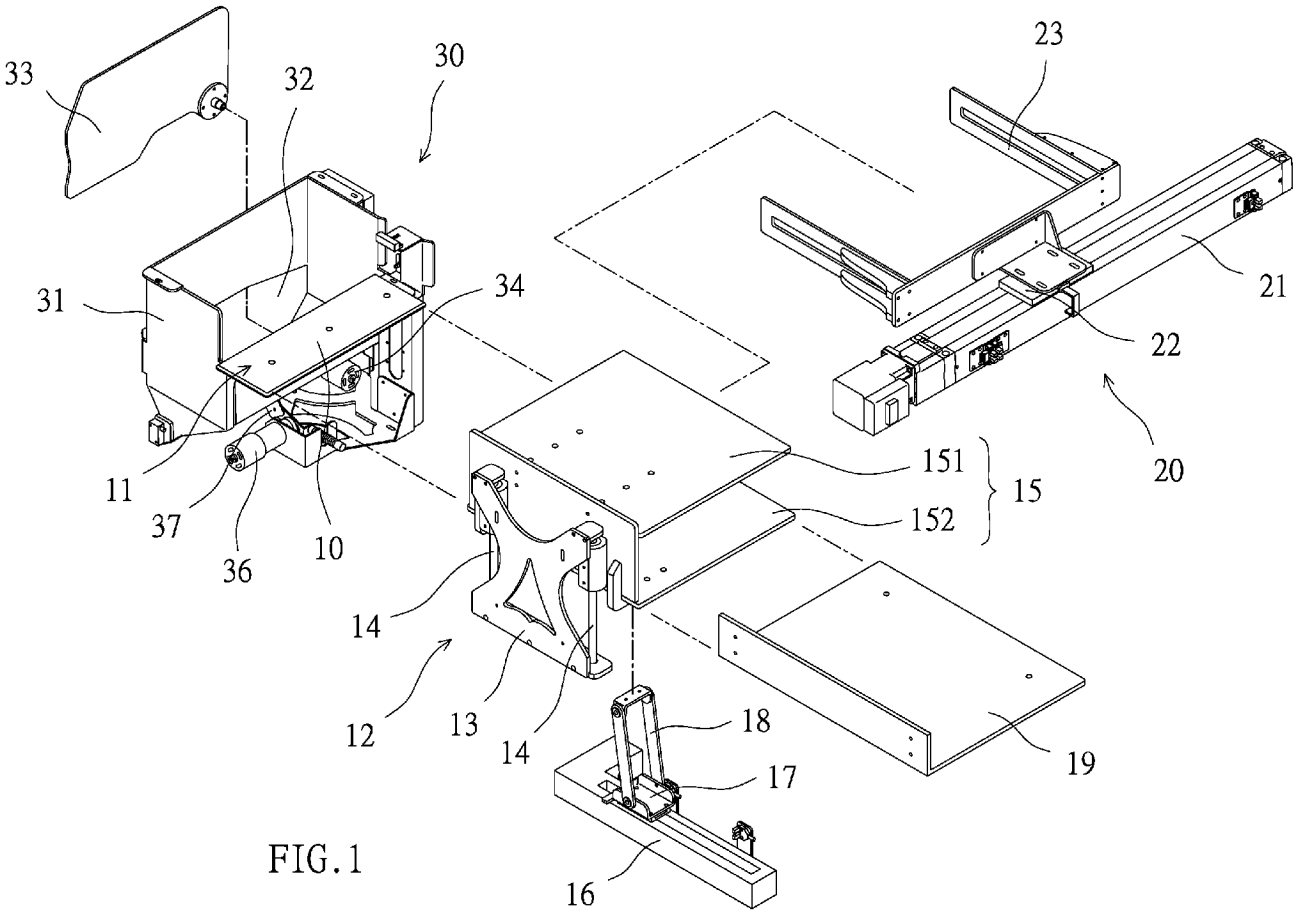
FIG. 1 is an exploded view of the present invention.
Figure 2:
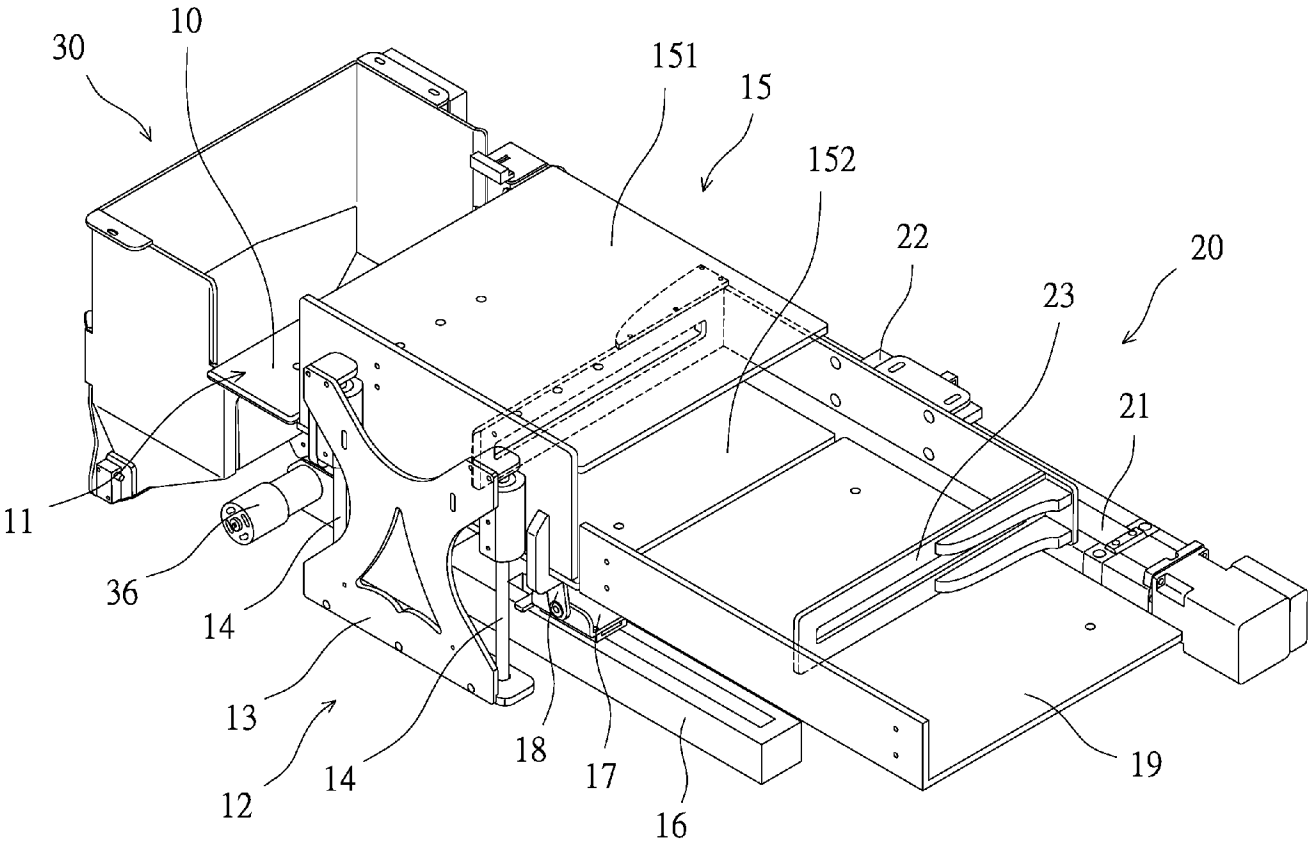
FIG. 2 is a perspective view of the present invention.
Figure 3:
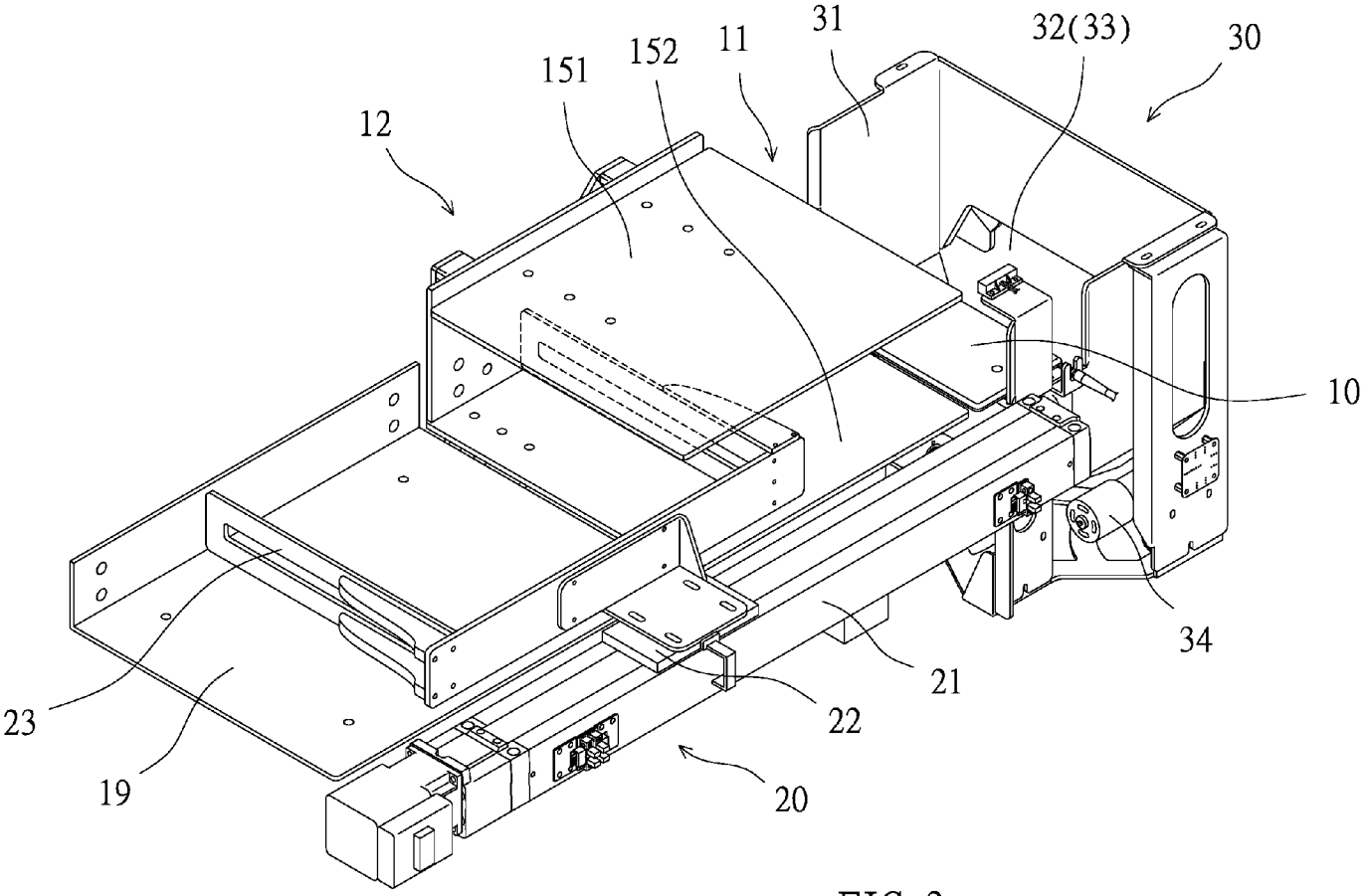
FIG. 3 is another perspective view of the present invention.

Embodiments of the present invention will now be described, by way of example only, with reference to the accompanying drawings.

As shown in FIG. 1 to FIG. 4, a push device for mahjong tiles of the present invention comprises an input platform 10, a lift mechanism 12, a changeover platform 19, a push mechanism 20, and a discard mechanism 30. One end of the input platform 10 is an input end 11 for externally inputting mahjong tiles 1 arranged in a low for playing a game. The lift mechanism 12 includes a rail seat 13 and a pair of rails 14 at two sides of the rail seat 13. The rails 14 are coupled with a lift platform 15. A short slide table assembly 16 is provided beneath the lift platform 15. The short slide table assembly 16 includes a first slide seat 17 thereon. The first slide seat 17 is pivotally connected with one end of a connecting rod 18. Another end of the connecting rod 18 is pivotally connected to a bottom of the lift platform 15. The lift platform 15 is composed of an upper platform 151 for drawing the tiles and a lower platform 152 for collecting the tiles. The first slide seat 17 is movable along the short slide table assembly 16, enabling the connecting rod 18 to pull or push the lift platform 15 for the lift platform 15 to ascend or descend vertically on the rails 14, such that one of the upper platform 151 and the lower platform 152 is level with one side of the input platform 10. The changeover platform 19 is disposed at one side of the lift platform 15, and is level with the input platform 10. The push mechanism 20 includes a long slide table assembly 21 having a second slide seat 22 thereon. The second slide seat 22 is coupled with a U-shaped push frame 23. The push mechanism 20 is disposed at respective one side of the input platform 10, the lift platform 15, and the changeover platform 19. The second slide seat 22 is movable along the long slide table assembly 21, enabling the U-shaped push frame 23 to slide horizontally between the input platform 10, the lift platform 15, and the changeover platform 19. The discard mechanism 30 includes a discard barrel 31 having an upper opening disposed at another end of the input platform 10. One side of the discard barrel 31 is formed with a retrieve opening 32 having a gate 33. The gate 33 is connected with a first motor 34 for controlling opening or closing of the gate 33. A bottom of another side of the discard barrel 31 is pivotally connected with a push board 35. A bottom side of the push board 35 is provided with a second motor 36 having a crank. The crank is connected with one end of a link rod 37. Another end of the link rod 37 is pivotally connected with the push board 35, enabling the push board 35 to reciprocate. Through the aforesaid device, the U-shaped push frame 23 is displaced for the mahjong tiles 1 inputted from the input platform 10 to enter the U-shaped push frame 23. The U-shaped push frame 23 pushes the mahjong tiles 1 low by low to the lower platform 152. When the mahjong tiles 1 on the lower platform 152 reaches a predetermined amount, the U-shaped push frame 23 pushes all the mahjong tiles 1 to the changeover platform 19, and the lift platform 15 is descended for the upper platform 151 to be level with the input platform 10 and the changeover platform 19. The U-shaped push frame 23 pushes the mahjong tiles 1 from the changeover platform 19 to the upper platform 151. In the meanwhile, an outside of the U-shaped push frame 23 pushes the remaining mahjong tiles 1 of the last game to the discard barrel 31. Afterward, the lift platform 15 is ascended, enabling the lower platform 152 to be level with the input platform 10 and the changeover platform 19 to input mahjong tiles 1 for the next game. The mahjong tiles 1 on the upper platform 151 can be taken by a robotic arm for playing a game to save the playtime. The present invention can increase the economic benefits of a game machine.

The details of the assembly of the present invention are described as below. As shown in FIG. 1 to FIG. 4, the input platform 10, the rail seat 13, the short slide table assembly 16, the changeover platform 19, the long slide table assembly 21, and the discard mechanism 30 are all coupled on the machine platen 2. The width of the opening of the U-shaped push frame 23 is greater than the width of the lift platform 15, so that the lift platform 15 is able to ascend and descend vertically within the U-shaped push frame 23, not interfering with each other. Through the design of the dual-layer lift platform 15, the upper platform layer 151 is adapted for drawing tiles when the game is in progress and the lower platform layer 152 is adapted for the mahjong tiles 1 ready for the next game. The U-shaped push frame 23 can be displaced horizontally to push the mahjong tiles 1 between the input platform 10, the lower platform 152, and the changeover platform 19 to save the playtime.

Figure 4:
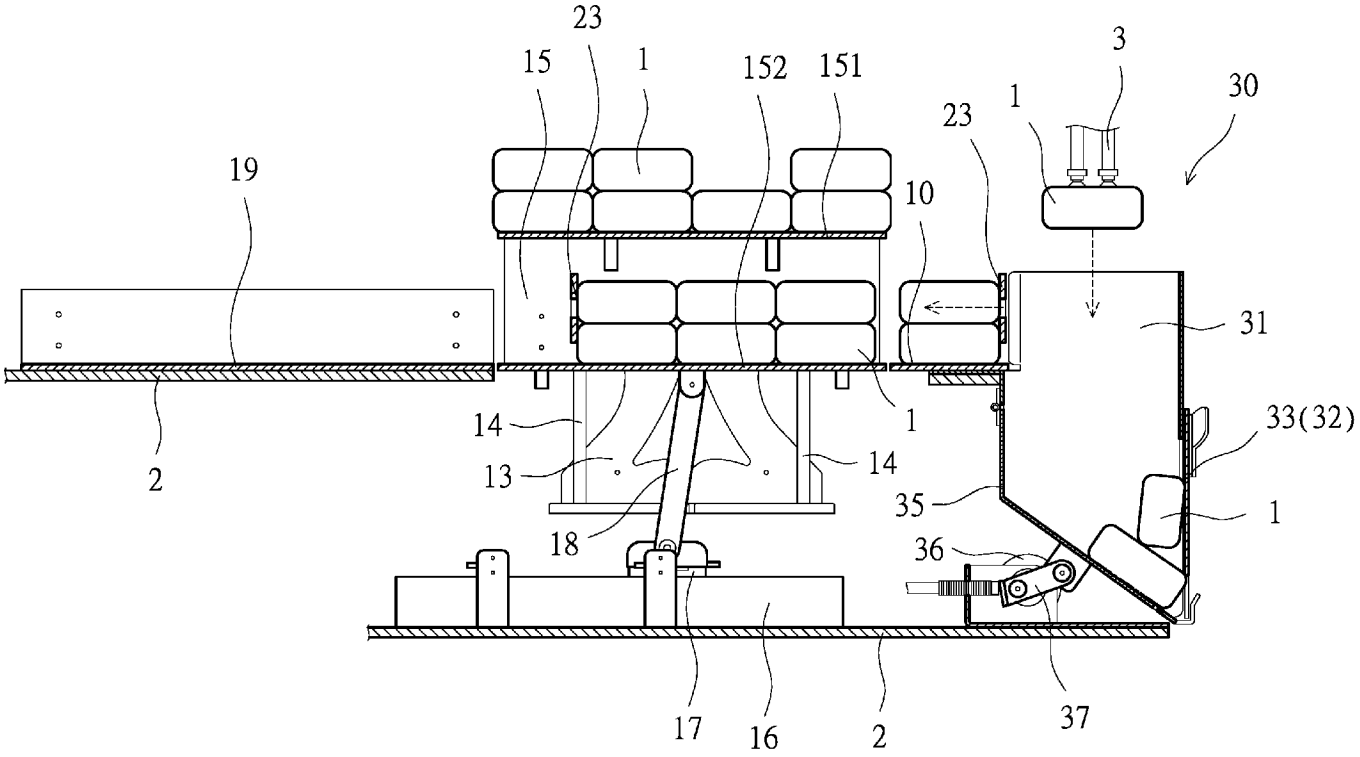
FIG. 4 is a side sectional view showing the U-shaped push frame of the present invention to push the mahjong tiles to be collected together.
Figure 5:
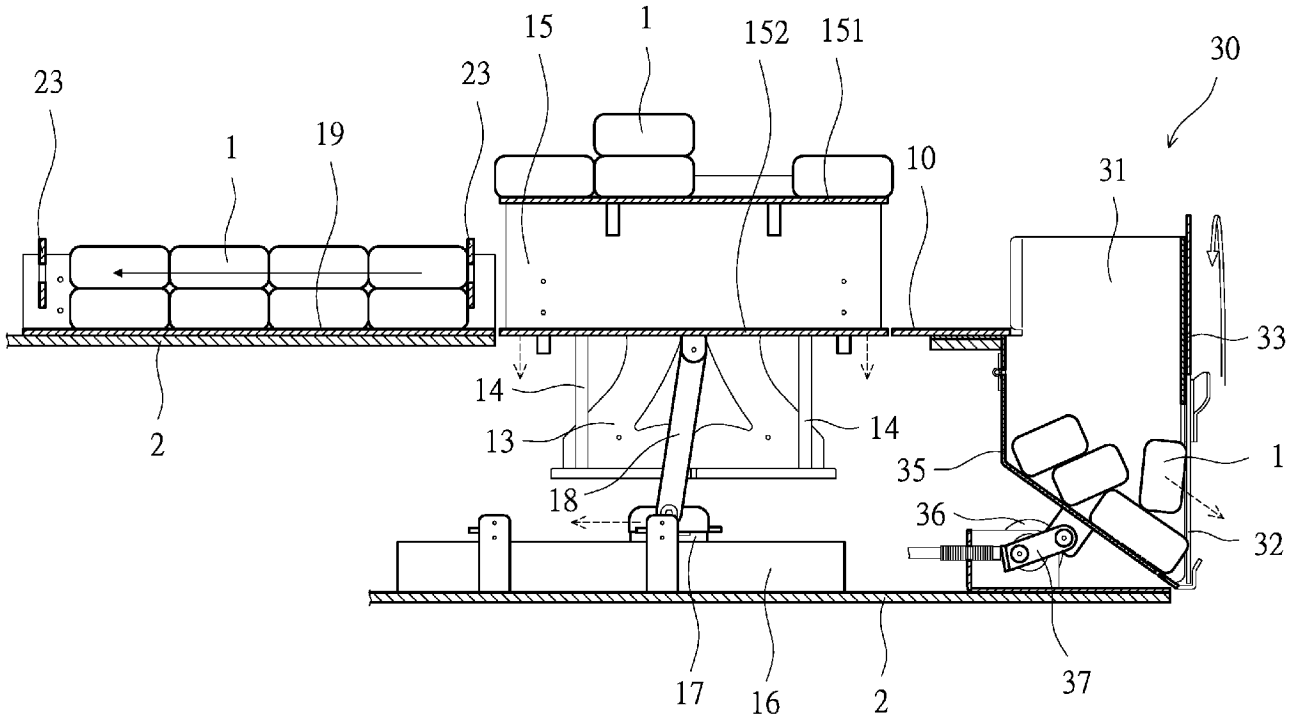
FIG. 5 is a side sectional view showing the U-shaped push frame of the present invention to push the mahjong tiles to the changeover platform.
Figure 6:
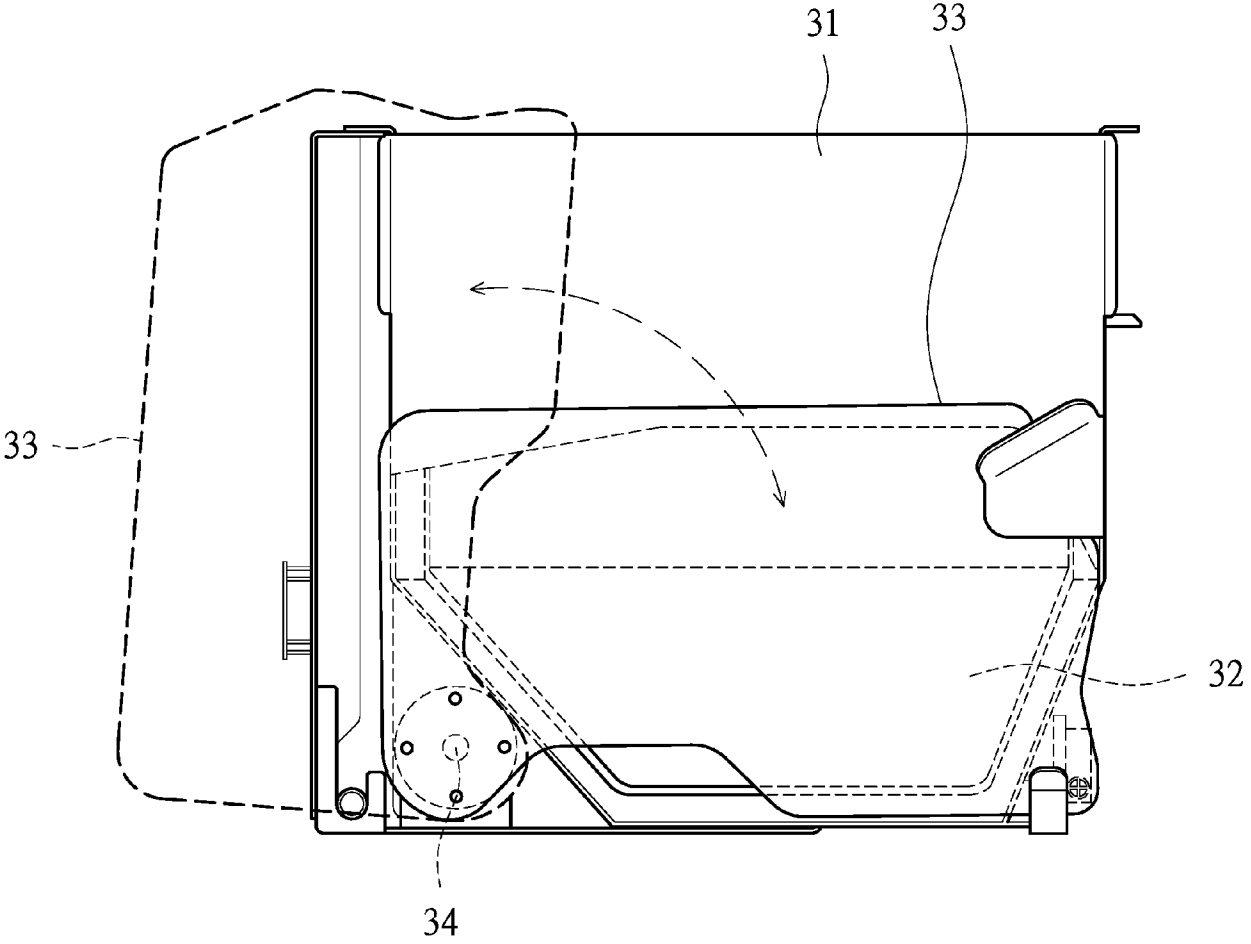
FIG. 6 is a schematic view showing opening and closing of the gate of the discard barrel of the present invention.
Figure 7:
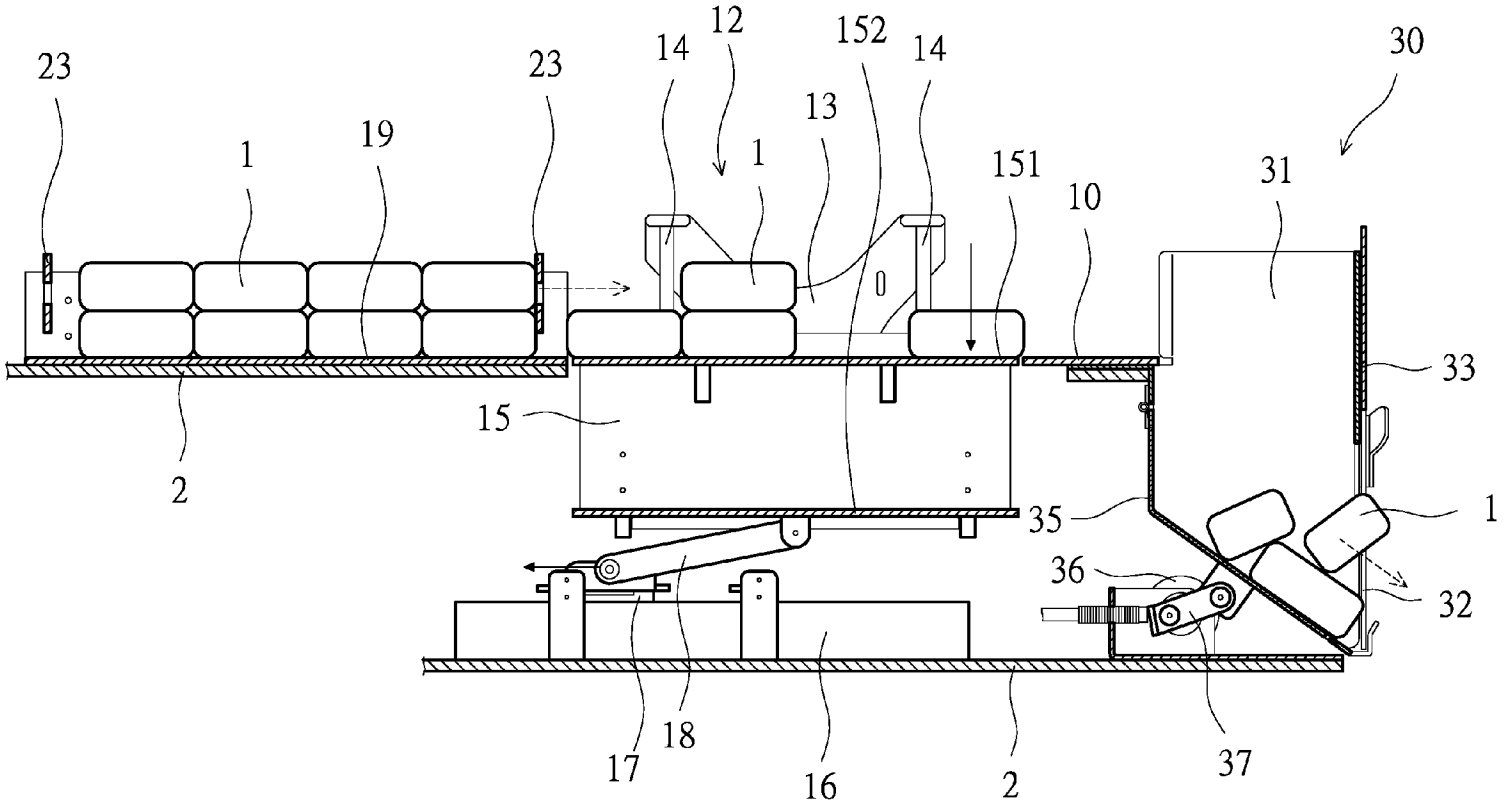
FIG. 7 is a side sectional view showing the descent of the lift platform of the present invention.
Figure 8:
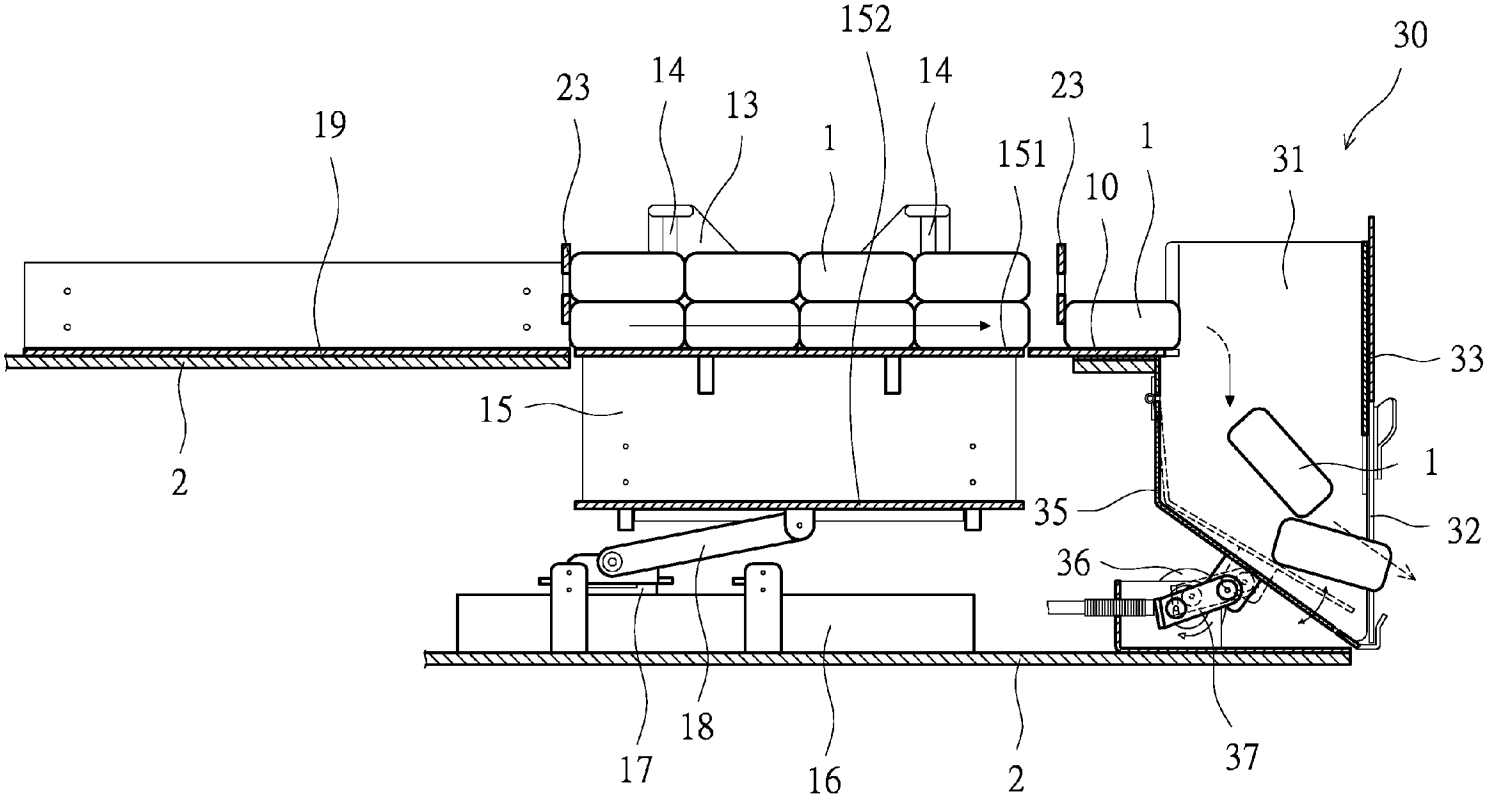
FIG. 8 is a side sectional view showing the U-shaped push frame of the present invention to push the mahjong tiles to the upper platform.
Figure 9:
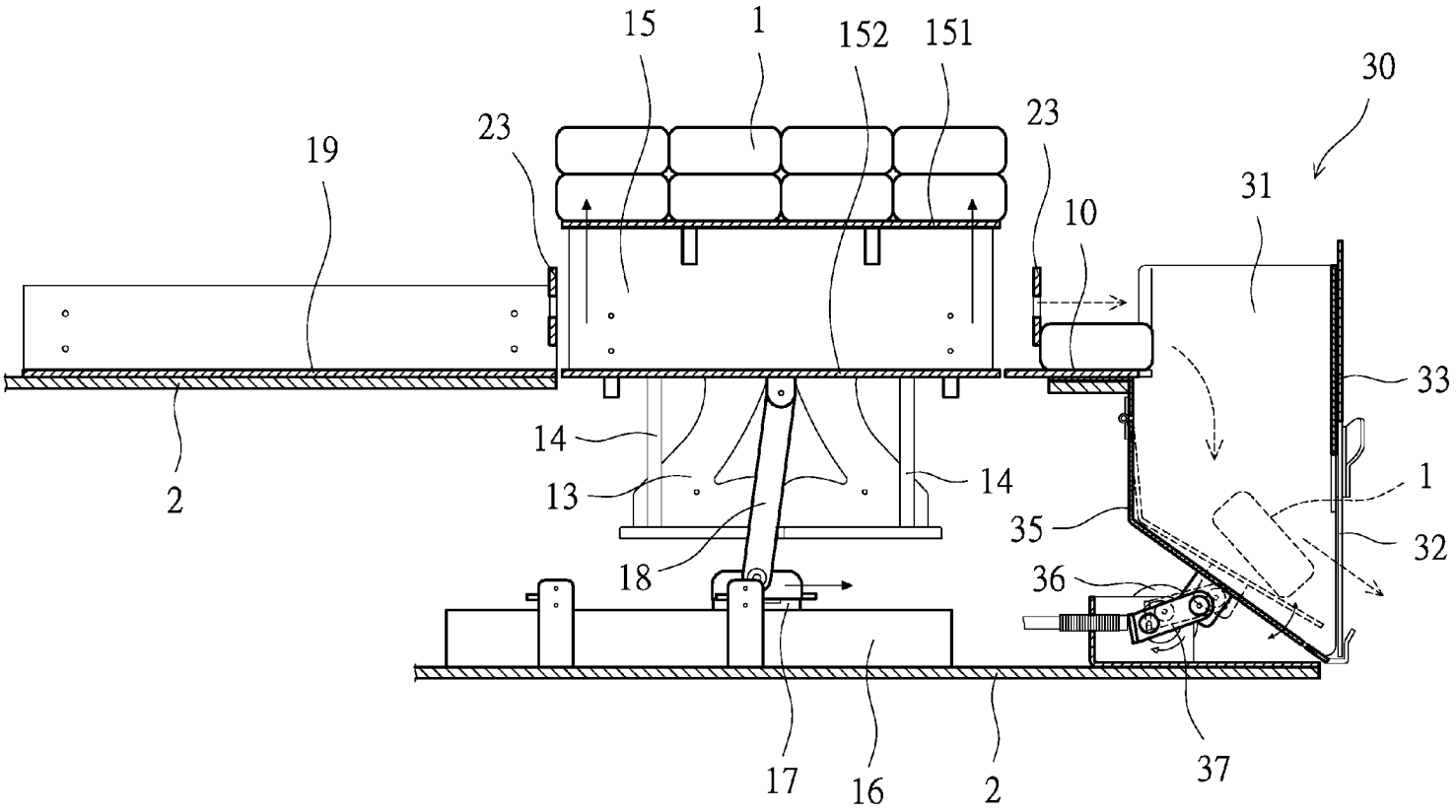
FIG. 9 is a side sectional view showing the ascent of the lift platform of the present invention.

Please refer to FIG. 1 to FIG. 9, when a set of mahjong tiles 1 has been placed on the upper platform 151 of the lift platform 15 and the computer mahjong game is in progress. A sucker 3 of the robotic arm can draw the mahjong tiles 1 one by one for the computer to identify or sense the suite and numeric of each mahjong tile 1. Each mahjong tile 1 is provided with a chip therein. Afterward, the mahjong tiles 1 are carried to be over the discard barrel 3 and then released to drop in the discard barrel 3. In the meanwhile, the U-shaped push frame 23 is horizontally moved to the edge of the input platform 10. The width of the U-shaped push frame 23 is able to receive plural rows of mahjong tiles 1. When a row of mahjong tiles 1 are inputted externally from the input platform 10, the U-shaped push frame 23 is reciprocated to push the mahjong tiles 1 to the lower platform 152 to be collected thereon, as shown in FIG. 4. When the mahjong tiles 1 are collected to reach the required amount for playing a game, all the collected mahjong tiles 1 are horizontally pushed by the U-shaped push frame 23 to the changeover platform 19, as shown in FIG. 5. When the game is over, the input platform 10 stops inputting the mahjong tiles 1. The gate 33 of the discard barrel 31 is opened, as shown in FIG. 6, for the mahjong tiles 1 in the discard barrel 31 to be retrieved from the retrieve opening 32. When the game is over, there will be some remaining mahjong tiles 1 on the upper platform 151. The lift platform 15 is descended vertically, enabling the upper platform 151 to be level with the input platform 10 and the changeover platform 19, as shown in FIG. 7. The U-shaped push frame 23 pushes the mahjong tiles 1 on the changeover platform 19 to the upper platform 151, and then pushes all the mahjong tiles 1 on the upper platform 151 to the discard barrel 31, as shown in FIG. 8. The second motor 36 starts to run and the link rod 37 is reciprocated to pull and push the push board 35 to generate vibrations, which ensures the mahjong tiles 1 are output from the retrieve opening 32 fully. At this time, the U-shaped push frame 23 corresponds in position to the lift platform 15. A low of mahjong tiles 1 are remained on the input platform 10, not pushed to the discard barrel 31. The lift platform 15 is ascended vertically to push the mahjong tiles 1 inside the U-shaped push frame 23, enabling the mahjong tiles 1 to be on the upper platform 151 (as shown in FIG. 9) for playing a game. At this time, the upper platform 152 is level with the input platform 10 and the changeover platform 19. Finally, the outside of the U-shaped push frame 23 pushes the mahjong tiles 1 remained on the input platform 10 to the discard barrel 31. The push board 35 is vibrated again for the mahjong tiles 1 to be output through the retrieve opening 32 smoothly. The gate 33 is closed again, and the input platform 10 inputs the mahjong tiles 1 once again for the next game. The operation can be repeatedly to provide an automation function and reduce human intervention and decrease the waiting time for playing games.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A push device for mahjong tiles, comprising an input platform, a lift mechanism, a changeover platform, a push mechanism, and a discard mechanism; one end of the input platform being an input end for externally inputting mahjong tiles arranged in a low for playing a game; the lift mechanism comprising a rail seat and a pair of rails at two sides of the rail seat, the rails being coupled with a lift platform, a short slide table assembly being provided beneath the lift platform, the short slide table assembly comprising a first slide seat thereon, the first slide seat being pivotally connected with one end of a connecting rod, another end of the connecting rod being pivotally connected to a bottom of the lift platform; the lift platform being composed of an upper platform and a lower platform, the first slide seat being movable along the short slide table assembly, enabling the connecting rod to pull or push the lift platform for the lift platform to ascend or descend vertically on the rails and one of the upper platform and the lower platform to be level with one side of the input platform; the changeover platform being disposed at one side of the lift platform and level with the input platform; the push mechanism comprising a long slide table assembly having a second slide seat thereon, the second slide seat being coupled with a U-shaped push frame, the push mechanism being disposed at respective one side of the input platform, the lift platform, and the changeover platform, the second slide seat being movable along the long slide table assembly, enabling the U-shaped push frame to slide horizontally between the input platform, the lift platform, and the changeover platform; the discard mechanism comprising a discard barrel having an upper opening disposed at another side of the input platform, one side of the discard barrel being formed with a retrieve opening having a gate, the gate being connected with a first motor for controlling opening or closing of the gate; thereby, the U-shaped push frame being displaced for the mahjong tiles inputted from the input platform to enter the U-shaped push frame, the U-shaped push frame pushing the mahjong tiles low by low to the lower platform, when the mahjong tiles on the lower platform reaches a predetermined amount, the U-shaped push frame pushing the mahjong tiles to the changeover platform, the lift platform being descended for the upper platform to be level with the input platform and the changeover platform, the U-shaped push frame pushing the mahjong tiles from the changeover platform to the upper platform, an outside of the U-shaped push frame synchronously pushing the remaining mahjong tiles of the last game to the discard barrel, the lift platform being ascended, enabling the lower platform to be level with the input platform and the changeover platform again to input the mahjong tiles for the next game.

2. The push device for mahjong tiles as claimed in claim 1, wherein a bottom of another side of the discard barrel is pivotally connected with a push board, a bottom side of the push board is provided with a second motor having a crank, the crank is connected with one end of a link rod, and another end of the link rod is pivotally connected with the in push board, enabling the push board to reciprocate.

3. The push device for mahjong tiles as claimed in claim 1, wherein the U-shaped push frame has an opening with a width greater than a width of the lift platform.

* * * * *